US005758867A

United States Patent [19]

Arnesson

[11] Patent Number: 5,758,867

[45] Date of Patent: Jun. 2, 1998

[54] LIFTING DEVICE FOR THE CONTROLLED VERTICAL TRANSFER OF OBJECTS

[76] Inventor: Per-Olof Arnesson, Bjorkhaga-Korsarp, S-563 91 Granna, Sweden

[21] Appl. No.: 851,493

[22] Filed: May 5, 1997

Related U.S. Application Data

[63] Continuation of Ser. No. 464,824, filed as PCT/SE94/00004, Jan. 4, 1994 published as WO94/16267, Jul. 21, 1994.

[30] Foreign Application Priority Data

Jan. 8, 1993 [SE] Sweden ..... 9300035

[51] Int. Cl.[6] ..... B66F 3/18

[52] U.S. Cl. ..... 254/103; 254/47; 254/4 R; 254/DIG. 2

[58] Field of Search ..... 362/405, 404; 254/385, 386, 103, 47, 4 R, DIG. 2; 248/328, 332

[56] References Cited

U.S. PATENT DOCUMENTS

| | | | |
|---|---|---|---|
| 338,920 | 3/1886 | Brady | 248/332 |
| 1,477,790 | 12/1923 | Townsend | 254/103 |
| 1,763,144 | 1/1930 | Fuller | 254/DIG. 2 |
| 3,606,252 | 9/1971 | Dorough, Jr. | 254/DIG. 2 |
| 3,843,985 | 10/1974 | Leonhardt | 12/77 |
| 3,932,907 | 1/1976 | Vornberger | 12/77 |
| 4,168,053 | 9/1979 | Boenninghaus | 254/189 |
| 4,316,238 | 2/1982 | Booty et al. | 362/147 |
| 4,485,894 | 12/1984 | Soule et al. | 187/9 E |
| 4,649,585 | 3/1987 | Petrzelka et al. | 12/77 |
| 5,105,349 | 4/1992 | Falls et al. | 362/405 |
| 5,420,772 | 5/1995 | Evans | 362/405 |

FOREIGN PATENT DOCUMENTS

| | | |
|---|---|---|
| 0493297 A2 | 7/1992 | European Pat. Off. . |
| 39 13321 A1 | 11/1989 | Germany . |

*Primary Examiner*—James G. Smith
*Assistant Examiner*—Lee Wilson
*Attorney, Agent, or Firm*—Robert Platt Bell & Associates, P.C.

[57] ABSTRACT

A lifting device for the controlled vertical movement of objects, especially such objects, to which is conveyed an electric current through a line, such as chandeliers, is described. It is especially characterized by the combination of a relatively longitudinal support, provided with a longitudinal guide. A threaded, preferably trapezoidally-threaded driving shaft journaled in the ends of support which shaft is driven by a motor via worm gear unit. A carriage guided by the longitudinal guide which carriage is movable in the longitudinal direction of support with a nut fastened to carriage, cooperating with the driving shaft. A shaft provided perpendicularly in support carrying a first ring gear and chain relatively heavy and stable to turning, running over first ring gear, chain being driven by carriage to change its position in relationship to support as the position of carriage is changed in relationship to support by driving shaft, chain carrying in a first end the object.

15 Claims, 1 Drawing Sheet

LIFTING DEVICE FOR THE CONTROLLED VERTICAL TRANSFER OF OBJECTS

Figure 1:
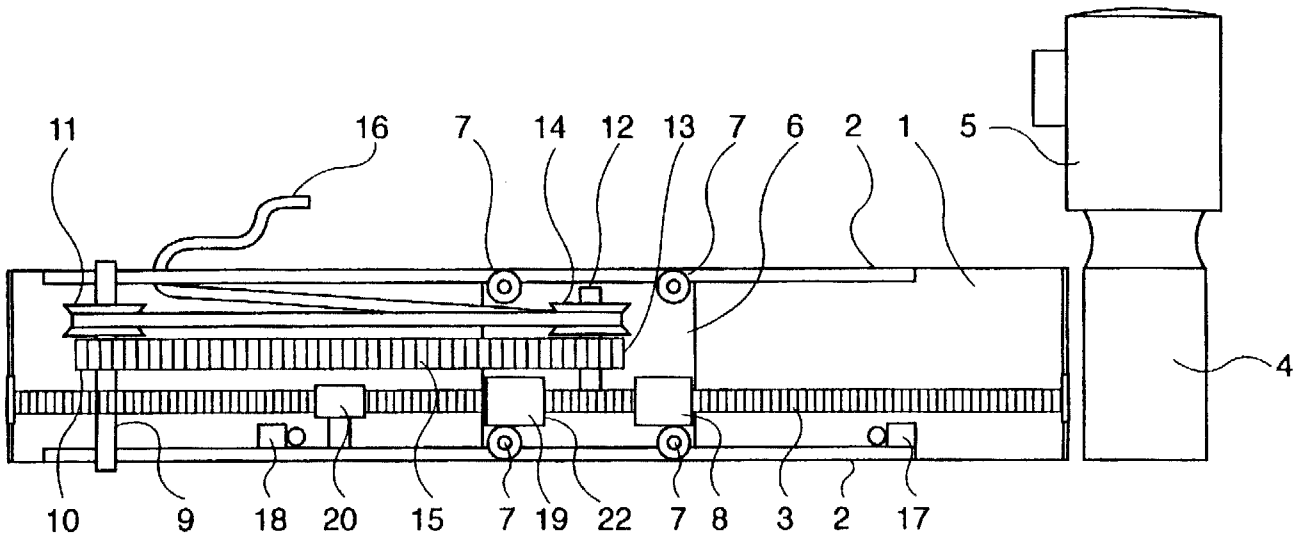

This application is a continuation of application Ser. No. 08/464,824, filed as PCT/SE94/00004, Jan. 4, 1994 published as WO94/16267, Jul. 21, 1994.

The present invention relates to a lifting device for the controlled vertical movement of objects, especially such objects, to which is conveyed an electric current through a line, such as chandeliers.

In assembly halls, like churches, theatres etc. there is often a need for a vertical movement of objects, well controlled, that is to say so that the objects may be set accurately vertically and so that they are not caused to perform any turning movement during or after the vertical movement. There may be chandeliers, pictures, set- pieces etc. The chandeliers may have electric lights and candles, which are common in churches, which means, that they must be available for replacing electric lights and more often for replacing candles. If there are no suitable lifting devices, and the objects rust be made available with the aid of a ladder or the like, there is much work to be done.

Thus there is a need for a simple and reliable lifting device of the art mentioned introductorily, which is constructed in a not to complicated way, and the object of the present invention is to provide such a lifting device.

According to the invention such a device is primarily characterized by the combination of a relatively longitudinal support, provided with longitudinal guiding means, furthermore a threaded, preferably trapezoidally-threaded shaft, journalled in the ends of the support which shaft is driven by a motor via a worm gear unit, furthermore a carriage, guided by said longitudinal guiding means, which carriage is movable in the longitudinal direction of the support, with a nut, fastened to the carriage, cooperating with said driving shaft, furthermore a shaft provided perpendicularly in the support, carrying a 1:st gear ring, and a chain, relatively heavy and stable to turning, running over said gear ring, the chain being driven by said carriage to change its position in relationship to the support as the position of the carriage is changed in relationship to the support by the driving shaft, the chain carrying in a 1:st end of said object.

Different embodiments are possible within the scope of the invention. The driving shaft may be driven in any of the ends of the support. The support is intended to be mounted primarily horizontally or substantially horizontally in an attic or on attic beams, so that the chain can run downwardly via said gear ring through an opening in the roof, in which a chandelier or other object is hanging.

In one advantageous embodiment of the invention, the lifting device is arranged in such a way, that said shaft, provided perpendicularly in the support, also carries a 1:st pulley, over which there is an electric wire running, the same also being driven by said carriage to change its position in relationship to the support (1) as the position of the carriage in relationship to the support (1) is changed by the driving shaft (3), the end of the wire (16) being connected in a 1:st end to said object. The other end of the wire is connected, possibly via a connecting means, to the electric mains.

Per se, the chain may be fixed directly to the carriage, which also is true for the other end of the wire, if any, which in that case had to be connected to a movable wire, which in turn had to be connected to the electric mains. More available possible vertical movement length is gained, however, at a given length of the support, if the chain, and the electric wire, if any, are fixed to the support, preferably in the vicinity of said shaft, provided perpendicularly in the support, and the carriage is provided with a perpendicular shaft, which carries a 2:nd gear ring with a 2:nd pulley over which the chain resp. the wire are running before the contact with said 1:st gear ring and 1:st pulley.

The lifting device according to the invention may, in an advantageous embodiment be provided with a limit switch, which increases the safety in utilizing the lifting device and furthermore facilitates the vertical setting at a certain height of the actual object. Per se the limit switches may be arranged themselves to be movable along the support, at each side of the carriage, but in one suitable embodiment of the lifting device according to the invention, a 1:st limit switch for the electric voltage to said electric motor is provided in the support at its end, turned from the perpendicular shaft, the 1:st limit switch being acted upon by said carriage, whilst the 2:nd limit switch is provided in the support in the vicinity of the perpendicular shaft, the 2:nd limit switch being acted upon by a position indicator, provided with a nut means, embracing said driving shaft, guided in the longitudinal direction of the support by guiding means, possibly said guiding means.

The carriage may be guided in different ways in the support by said guiding means, and it is suitable to provide it with steering wheels, cooperating with guiding means provided in the support, in the form of guiding bars on the raised walls of a U-beam.

Figure 2:
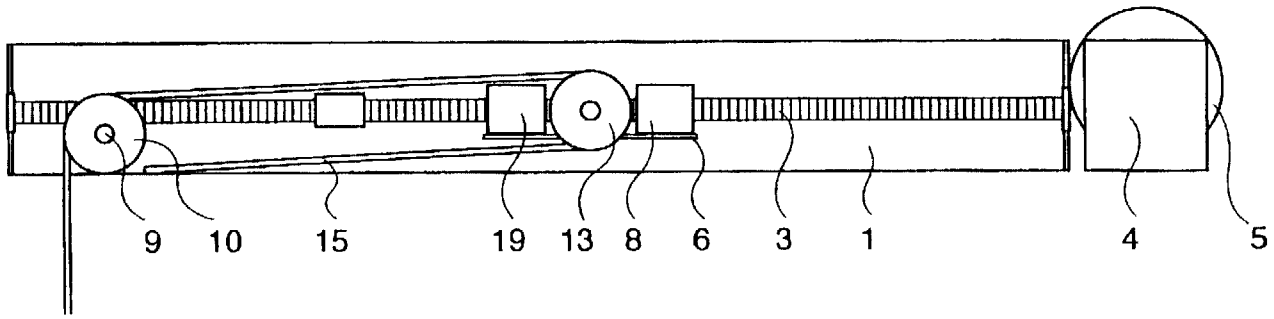

The invention shall be described in the following, reference being made to the two enclosed figures, of which FIG. 1 schematically shows a plan view of a lifting device according to the invention, whilst FIG. 2 schematically shows a view from the side, partly as a section, of same lifting device, that is shown in FIG. 1.

In FIG. 1 a longitudinal support in the form of a U- beam is denoted by 1, and on the walls of the U- beam at the inside, there are guiding bars 2, as guiding means. In the ends of the support, there is journalled a trapezoidally threaded driving shaft 3, driven via a gear worm 4 by an electric motor 5. In the support 1 there runs a carriage 6, provided with four steering wheels 7, which are guided by the guiding ban 2. A nut 8 is fixed to the carriage 6, embracing the driving shaft 3, which is made from steel, whilst the nut is made from bronze. In the support, in the vicinity of its end there is provided a perpendicular shaft 9 in the support, carrying a 1:st gear ring 10 and a 1:st pulley 11. In the carriage a second shaft 12 is arranged perpendicularly, carrying a 2:nd gear ring 13 and a 2:nd pulley 14. E relatively heavy chain 15, stable to tuning is fastened to the bottom of the support, in the vicinity to said perpendicular shaft, provided in the support. The chain runs over the 2:nd gear ring, turns over and runs over th 1:st gear ring and thereby changes direction 90° if the support is mounted horizontally, and carries in its free end the actual object which is best shown in FIG. 2. An electric wire 16 is fixed to the support longitudinally seen at level with the fixing point of the chain in the support, then runs up over the 2:nd pulley and further to the 1:st pulley, then changes direction 90° and goes down to the object, where the end of the wire is connected to a light source or other current consumer.

When the driving shaft 3 is brought to rotate in the desired direction by the electric motor 5, via a worm gear 4, which may have a exchange gear reduction of 14:1, the carriage 6 is moved in the desired direction, running smoothly, and the chain 15 resp the wire 16 are extended or reduced a desired stretch. A 1:st limit switch 17 is fixed to the support on the side of the carriage 6, turned to the electric motor 5, and a 2:nd limit switch 18 is fixed to the support on the other side of the carriage. A position indicator, formed like a nut 19 embraces the the driving shaft and is moved with this at the same rate as the carriage 6, as it is prevented from rotating by a tap 20, guided by the guiding bar 2. The nut 19 is suitably formed so that it can be opened, so that it can be moved along the driving shaft 3 to a desired breaking position An extra nut 21 runs freely on the driving shaft 3 at the carriage 6. In these there is a stop 22. If the fixed nut would break, the forced movement of the carriage 6 is stopped by the nut 21 and the stop 22.

I claim:

1. A ceiling mounted lifting device for suspending and controlling vertical movement of objects from a ceiling, said ceiling mounted lifting device comprising:

a relatively longitudinal horizontal support attached to the ceiling, provided with longitudinal guiding means;

a horizontally mounted threaded driving shaft journaled in the ends of the support;

a worm gear unit coupled to the threaded shaft for turning the threaded shaft;

a carriage guided by said longitudinal guiding means which carriage is movable in a longitudinal direction of the support by a nut fastened to the carriage, cooperating with said driving shaft;

a shaft provided perpendicularly in the support carrying a first gear ring and a relatively heavy and stable chain, said chain running over said gear ring, the chain being driven by said carriage to change its position in relationship to the support as the position of the carriage is changed in relationship to the support by the driving shaft, the chain for supporting and connecting to said object.

2. A lifting device according to claim 1, characterized in that said shaft provided perpendicularly in the support also carries a first pulley over which there is an electric wire running, the same also being driven by said carriage to change its position in relationship to the support as the position of the carriage in relationship to the support is changed by the driving shaft, the end of the wire for connecting to said object.

3. A lifting device according to claim 2, characterized in that the chain and the wire are fixed to the support, preferably near said shaft, provided perpendicularly to the support and that the carriage is provided with a perpendicular shaft, which carries a second gear ring with a second pulley over which the chain and the wire are provided to run before contact with said first gear ring and the first pulley.

4. A lifting device according to any of claims 1 to 3, characterized by a first limit switch for the electric voltage to the electric motor, provided in the support in its end turned from the shaft, provided perpendicularly, the first limit switch being acted upon by said carriage, and a second limit switch provided in the support in the vicinity of the shaft, provided perpendicularly, the second limit switch being acted upon by a position indicator, provided with a nut means, embracing said driving shaft guided in the longitudinal direction of the support by guiding means, possible said guiding means.

5. A lifting device according to claim 4, characterized in that said carriage is provided with steering wheel, cooperating with guiding means in the support in the form of guiding bars on the raised walls of a U-beam.

6. A ceiling mounted lifting device for suspending and controlling vertical movement of objects from a ceiling, said ceiling mounted lifting device comprising:

a relatively longitudinal horizontal support attached to the ceiling, provided with longitudinal guiding means;

a horizontally mounted threaded driving shaft journaled in the ends of the support;

a worm gear unit coupled to the threaded shaft for turning the threaded shaft;

a carriage guided by said longitudinal guiding means which carriage is movable in a longitudinal direction of the support by a nut fastened to the carriage, cooperating with said driving shaft;

a shaft provided perpendicularly in the support carrying a first gear ring and a connecting means, said connecting means running over said gear ring, the connecting means being driven by said carriage to change its position in relationship to the support as the position of the carriage is changed in relationship to the support by the driving shaft, the connecting means for supporting and connecting to said object.

7. A lifting device according to claim 6, characterized in that said shaft provided perpendicularly in the support also carries a first pulley over which there is an electric wire running, the same also being driven by said carriage to change its position in relationship to the support as the position of the carriage in relationship to the support is changed by the driving shaft, the end of the wire for connecting to said object.

8. A lifting device according to claim 7, characterized in that the connecting means and the wire are fixed to the support, preferably near said shaft, provided perpendicularly to the support and that the carriage is provided with a perpendicular shaft, which carries a second gear ring with a second pulley over which the connecting means and the wire are provided to run before contact with said first gear ring and the first pulley.

9. A lifting device according to claim 6, characterized by a first limit switch for the electric voltage to the electric motor, provided in the support perpendicularly, the first limit switch being acted upon by said carriage, and a second limit switch provided in the support in the vicinity of the shaft, provided perpendicularly, the second limit switch being acted upon by a position indicator, provided with a nut means, embracing said driving shaft guided in the longitudinal direction of the support by guiding means, possible said guiding means.

10. A lifting device according to claim 9, characterized in that said carriage is provided with steering wheel, cooperating with guiding means in the support in the form of guiding bars on the raised walls of a U-beam.

11. A lifting device according to claim 7, characterized by a first limit switch for the electric voltage to the electric motor, provided in the support perpendicularly, the first limit switch being acted upon by said carriage, and a second limit switch provided in the support in the vicinity of the shaft, provided perpendicularly, the second limit switch being acted upon by a position indicator, provided with a nut means, embracing said driving shaft guided in the longitudinal direction of the support by guiding means, possible said guiding means.

12. A lifting device according to claim 8, characterized by a first limit switch for the electric voltage to the electric motor, provided in the support perpendicularly, the first limit switch being acted upon by said carriage, and a second limit switch provided in the support in the vicinity of the shaft, provided perpendicularly, the second limit switch being acted upon by a position indicator, provided with a nut means, embracing said driving shaft guided in the longitudinal direction of the support by guiding means, possible said guiding means.

13. A lifting device according to claim 11, characterized in that said carriage is provided with steering wheel, cooperating with guiding means in the support in the form of guiding bars on the raised walls of a U-beam.

14. A lifting device according to claim 12, characterized in that said carriage is provided with steering wheel, cooperating with guiding means in the support in the form of guiding bars on the raised walls of a U-beam.

15. A chandelier lift, comprising:

a frame member having a major dimension in a horizontal plane along a first axis;

a threaded shaft rotatably coupled to the frame member lying in an axis parallel to the first axis;

a first shaft, rotatably coupled to the frame member, lying substantially in the horizontal plane in an axis substantially perpendicular to the first axis;

a first pulley attached to the first shaft for carrying an electric wire for powering the chandelier;

a first gear attached to the first shaft to carrying a chain for supporting the chandelier;

a carriage slidably mounted to the frame member for travel substantially in the horizontal plane in the first axis, said carriage having at least one threaded member for engaging the threaded shaft such that rotational movement of the threaded shaft causes the carriage to move along the first axis;

a second shaft, rotatably coupled to the carriage, lying substantially in the horizontal plane in an axis perpendicular to the first axis;

a second pulley attached to the second shaft for carrying the electric wire for powering the chandelier; and a second gear attached to the second shaft to carrying the chain for supporting the chandelier;

wherein one end of the chain is attached to the frame member and another end of the chain is attached to the chandelier, such that when the carriage is moved along the first axis, the chain passes over the first pulley causing the chandelier to move.

* * * * *